US007988066B2

(12) United States Patent
Hughes et al.

(10) Patent No.: US 7,988,066 B2
(45) Date of Patent: Aug. 2, 2011

(54) RAIL TRACK CROSSING

(75) Inventors: James Lawson Hughes, Martin (AU); Ridolfo Carace Bumett, Rockingham (AU); Henry Dixie Stephen, South Perth (AU)

(73) Assignee: Newstyle Nominees Pty Ltd, Martin, Western Australia (AU)

( * ) Notice: Subject to any disclaimer, the term of this patent is extended or adjusted under 35 U.S.C. 154(b) by 112 days.

(21) Appl. No.: 12/303,752

(22) PCT Filed: Jun. 13, 2007

(86) PCT No.: PCT/AU2007/000821

§ 371 (c)(1),
(2), (4) Date: Dec. 8, 2008

(87) PCT Pub. No.: WO2007/143781

PCT Pub. Date: Dec. 21, 2007

(65) Prior Publication Data

US 2010/0147966 A1 Jun. 17, 2010

(51) Int. Cl.
*E01B 1/00* (2006.01)

(52) U.S. Cl. ..... 238/8; 238/2; 238/7

(58) Field of Classification Search ..... 238/2, 3, 238/5, 6, 7, 8, 9

See application file for complete search history.

(56) References Cited

U.S. PATENT DOCUMENTS

| | | | | |
|---|---|---|---|---|
| 4,641,779 | A * | 2/1987 | O'Brien et al. | 238/7 |
| 4,783,001 | A * | 11/1988 | Subrick | 238/53 |
| 5,464,152 | A * | 11/1995 | Wabnitz | 238/8 |
| 5,465,903 | A * | 11/1995 | Davis et al. | 238/8 |
| 5,535,948 | A * | 7/1996 | Williams | 238/8 |
| 5,799,868 | A * | 9/1998 | Neumann | 238/8 |
| 5,806,764 | A * | 9/1998 | Neumann | 238/2 |
| 5,813,602 | A * | 9/1998 | Holland | 238/8 |
| 6,079,630 | A * | 6/2000 | Schroeder | 238/8 |
| 6,196,470 | B1 * | 3/2001 | Neumann | 238/8 |
| 6,250,562 | B1 * | 6/2001 | Bruyn | 238/8 |
| 6,253,872 | B1 * | 7/2001 | Neumann | 181/210 |
| 6,422,478 | B1 * | 7/2002 | Lucas, Jr. | 238/8 |
| 6,431,462 | B1 * | 8/2002 | Apostolou et al. | 238/8 |
| 6,705,536 | B1 * | 3/2004 | Birt et al. | 238/8 |

(Continued)

FOREIGN PATENT DOCUMENTS

DE 20101567 4/2001

(Continued)

*Primary Examiner* — S. Joseph Morano
*Assistant Examiner* — Jason C Smith
(74) *Attorney, Agent, or Firm* — Gottlieb, Rackman & Reisman P.C.

(57) ABSTRACT

A rail track crossing comprising a support element (29) associated with each rail (11) of a rail track and configured to be supported from a sleeper (13) whereby the support element extends to each side of each rail, the support element having an engagement portion (31) which is to be at each side of the respective rail, a set of panels comprising a pair of lateral panels (37) and a central panel (39) wherein the central panel is to be received between the rails and supported upon the support elements and to be engaged by the engagement portions, the lateral panels being intended to be located to the sides of the rail track to be engaged with the engagement portion located at the respective side, wherein when the lateral panels and the central panel are in position their upper surfaces jointly provide a substantially continuous surface across the rail track.

24 Claims, 7 Drawing Sheets

U.S. PATENT DOCUMENTS

| | | | | |
|---|---|---|---|---|
| 6,871,791 | B1 * | 3/2005 | Egan, Jr. | 238/8 |
| 2003/0168519 | A1 * | 9/2003 | Hofstetter, Sr. | 238/8 |
| 2010/0147966 | A1 * | 6/2010 | Hughes et al. | 238/8 |

FOREIGN PATENT DOCUMENTS

| | | | |
|---|---|---|---|
| DE | 10152601 | | 4/2003 |
| JP | 2004339769 | | 12/2004 |
| JP | 2005232903 | | 9/2005 |
| JP | 2005290776 | | 10/2005 |
| WO | WO 2000/073588 | | 12/2000 |
| WO | WO 2002/090659 | | 11/2002 |
| WO | WO 0290659 | A1 * | 11/2002 |
| WO | WO 2004/007842 | | 1/2004 |
| WO | WO 2004007842 | A1 * | 1/2004 |
| WO | WO 2005/085529 | | 9/2005 |
| WO | WO 2005085529 | A1 * | 9/2005 |

* cited by examiner

RAIL TRACK CROSSING

FIELD OF THE INVENTION

This invention relates to a rail track crossing which is able to provide road vehicle access across a rail track.

Throughout the specification the term "rail track" shall be taken to include a rail way comprising a pair of parallel rails which are intended to support locomotives and railway rolling stock and which are each supported upon a set of spaced sleepers which are in turn supported upon a rail bed which can comprise ballast or the like.

Throughout the specification, unless the context requires otherwise, the word "comprise" or variations such as "comprises" or "comprising", will be understood to imply the inclusion of a stated integer or group of integers but not the exclusion of any other integer or group of integers.

BACKGROUND

Rail track crossings are installed across railway tracks in order to accommodate for road traffic and the like. Conventionally, railway crossings have been formed by building up the road to either side of the rail track and between the rails, such that a vehicle can pass over the rail track with minimal disturbance to the vehicle. Spacing is provided between the road material and the rails to each side of the rail to enable safe passage of the rail vehicle over the crossing. However a difficulty with this arrangement arises from the circumstance that when it becomes necessary to maintain the rails by a grinding action the machinery required to effect this grinding action must be able to access all of the active surfaces of the rail. In addition at times it becomes necessary to re-tamp the rail track to ensure that the track remains level to avoid derailment. Therefore when it becomes necessary to service a rail track which is associated with a rail track crossing of the form described above, it is necessary to uplift or remove all of the road works associated with the crossing in order that the rails of the rail track can be accessed for grinding and that the sleepers supporting the rail track can be accessed for tamping purposes. This involves a considerable disruption to the both the road and rail traffic past the crossing.

Alternative arrangements have been suggested for forming a rail track crossing which does not involve the building up of roadway and one example of this is a system marketed in Germany under the trade mark STRAILS by the company Gummieeik Kraiiberg Elastik GmbH while another system has been marketed in the UK marketed under the trade mark HOLDFAST™ by a British company Rose Hills Ltd. A difficulty with such rail track crossings arises from the failure of them to be able to accommodate for extreme loadings which can be asserted upon them as the result of the road traffic and the rail traffic to which they are subjected.

The discussion throughout this specification, of the background and prior art to the invention is intended only to facilitate an understanding of the present invention. It should be appreciated that the discussion is not an acknowledgement or admission that any of the material referred to was part of the common general knowledge in Australia as at the priority date of the application.

DISCLOSURE OF THE INVENTION

Throughout the specification and claims, unless the context requires otherwise, the word "comprise" or variations such as "comprises" or "comprising", will be understood to imply the inclusion of a stated integer or group of integers but not the exclusion of any other integer or group of integers.

According to one aspect the invention resides in rail track crossing comprising a support element associated with each rail of a rail track and configured to be supported from a sleeper whereby the support element extends to each side of each rail, the support element having an engagement portion which is to be at each side of the respective rail, a set of panels comprising a pair of lateral panels and a central panel wherein the central panel is to be received between the rails and supported upon the support elements and to be engaged by the engagement portions, the lateral panels being intended to be located to the sides of the rail track to be engaged with the engagement portion located at the respective side, wherein when the lateral panels and the central panel are in position their upper surfaces jointly provide a substantially continuous surface across the rail track.

According to a preferred feature of the invention the support elements comprises a pair of support elements where each pair of support element associated with a rail.

According to a preferred feature of the invention a plurality of support elements are located along the portion of the rail track accommodating the rail track crossing.

According to a preferred feature of the invention the outer portion of the support element proximate the respective outer side of the rail track has an upwardly extending abutment which is intended in use to engage the outer side face of the respective lateral panel According to a preferred feature of the invention the rail track crossing further comprises a pair of lateral supports which in use are to be located such that one is to be located to each side of the outer side of the rail track in spaced relation from the sleepers and wherein the lateral panel is dimensioned such that its outer lateral portion extends beyond the sleepers and is to be supported from the respective lateral support.

**A rail track crossing comprises a pair of lateral supports which in use are to be located such that one is to be located to each side of the rail track in spaced relation from the sleepers, a pair of support elements associated with each rail and configured to be supported from the sleeper to each side of the respective rail, the support element and having an engagement portion which is to be at each side of the respective rail, a set of panels comprising a pair of lateral panels and a central panel wherein the central panel is to be received between the rails and supported upon the support elements to engage the engagement portions, the lateral panels being intended to be located to one or the other side of the rail track between the lateral support and most proximate rail and to be engaged with the most proximate engagement portion, wherein when the lateral panels and the central panel are in position their upper surfaces jointly provide a substantially continuous surface across the rail track.

According to a preferred feature of the invention each lateral support is provided with an engagement portion which is intended to be engaged with the respective lateral panel.

According to a preferred feature of the invention a plurality of support elements are provided to be supported on sleepers located in spaced relation along the portion of the length of the rail track associated with the rail track crossing.

According to a preferred feature of the invention a plurality of sets of panels are provided in an end to end relationship along the portion of the length of the rail track associated with the rail track crossing.

According to a preferred feature of the invention the engagement portions comprise an upstanding boss which is to be received within a recess of complementary configuration in the under face of the panels.

According to a preferred feature of the invention each support element comprises a support portion which is located in spaced relation to the respective side of the rail and an extension portion which extends from the support portion to terminate below the rail, wherein the extension portions of each support portion are capable of being interconnected at a position below the respective rail.

According to a preferred feature of the invention the panels are formed of reinforced concrete or like cementitious material. According to an alternative preferred feature of the invention wherein the panels are formed of a polymeric or elastomeric composition.

According to a preferred feature of the invention the upper surface of the panels are provided with an anti-skid surface.

According to a preferred feature of the invention each of the panels are provided with lifting points whereby the panel can be engaged at the lifting points and lifted into and out of the position on the rail track.

According to a preferred feature of the invention each lateral panel is provided with a rail engaging means, adapted to prevent upward movement of the edge of lateral panel adjacent the rail from the upper surface of the rail.

According to a preferred feature of the invention the central panel is provided with a rail engaging means, adapted to prevent upward movement of the edge of central panel adjacent the rail from the upper surface of the rail.

According to a preferred feature of the invention the rail engaging means is provided in the form of an extensible member provided within an aperture in a rail-facing side wall of the lateral or central panel. According to a preferred feature of the invention in use, the extensible member is extended from the aperture in the rail-facing side wall of the lateral or central panel to secure the lateral or central panel against the rail the extensible member is adapted to engage the rail beneath the head of the rail, thereby at least inhibiting vertical movement of the lateral or central panel. According to a preferred feature of the invention a biasing means biases the extensible member from the aperture. According to a preferred feature of the invention the biasing means comprises a spring. According to a preferred feature of the invention the portion of the extensible member that in use is to abut the rail is formed from an electrically non-conducting material.

According to a preferred feature of the invention the rail engaging means is provided with a locking means, adapted to lock the extensible member in position against the rail.

According to a preferred feature of the invention the locking means comprises one of more apertures through the extensible member, and a pin, receivable through one of said apertures to maintain the extensible member in engagement with the rail. According to a preferred feature of the invention the pin comprises a bolt which is threadably receivable in the apertures.

According to a preferred feature of the invention the underside of the lateral and/or central panels is formed with apportion which is shaped to be received between least one pair of adjacent sleepers to prevent axial movement of the panels relative to the rail track.

The invention will be more fully understood in the light of the following description of several specific embodiments.

BRIEF DESCRIPTION OF THE DRAWINGS

The description is made with reference to the accompanying drawings of which.

DETAILED DESCRIPTION OF SPECIFIC EMBODIMENTS

Figure 1:
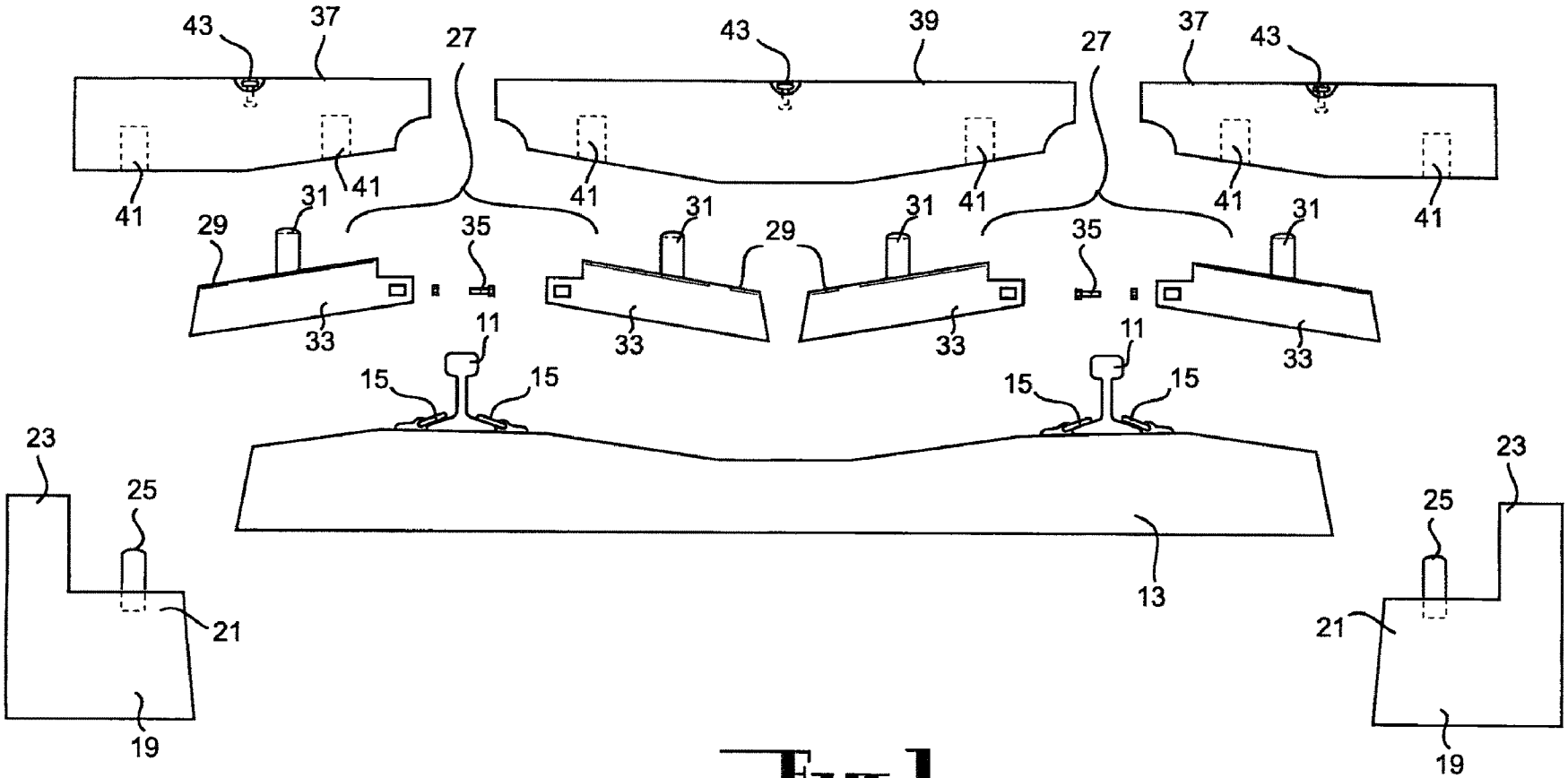
FIG. 1 is an exploded side elevation of the components of a rail track crossing according to the first embodiment.
Figure 2:
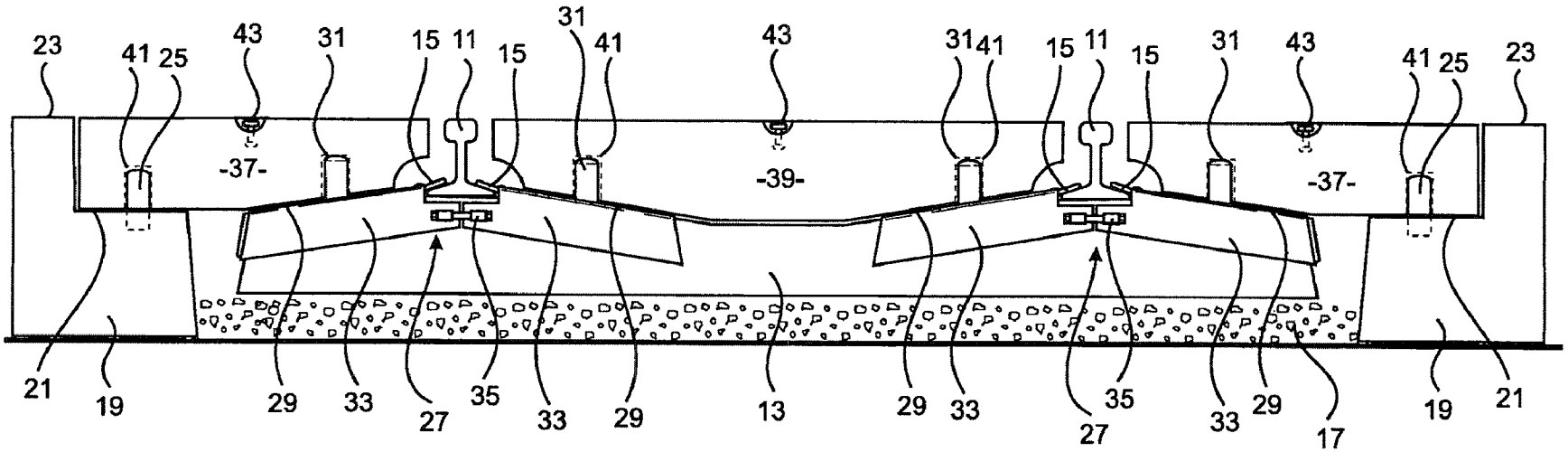
FIG. 2 is a sectional elevation of a rail track crossing according to the first embodiment.
Figure 3:
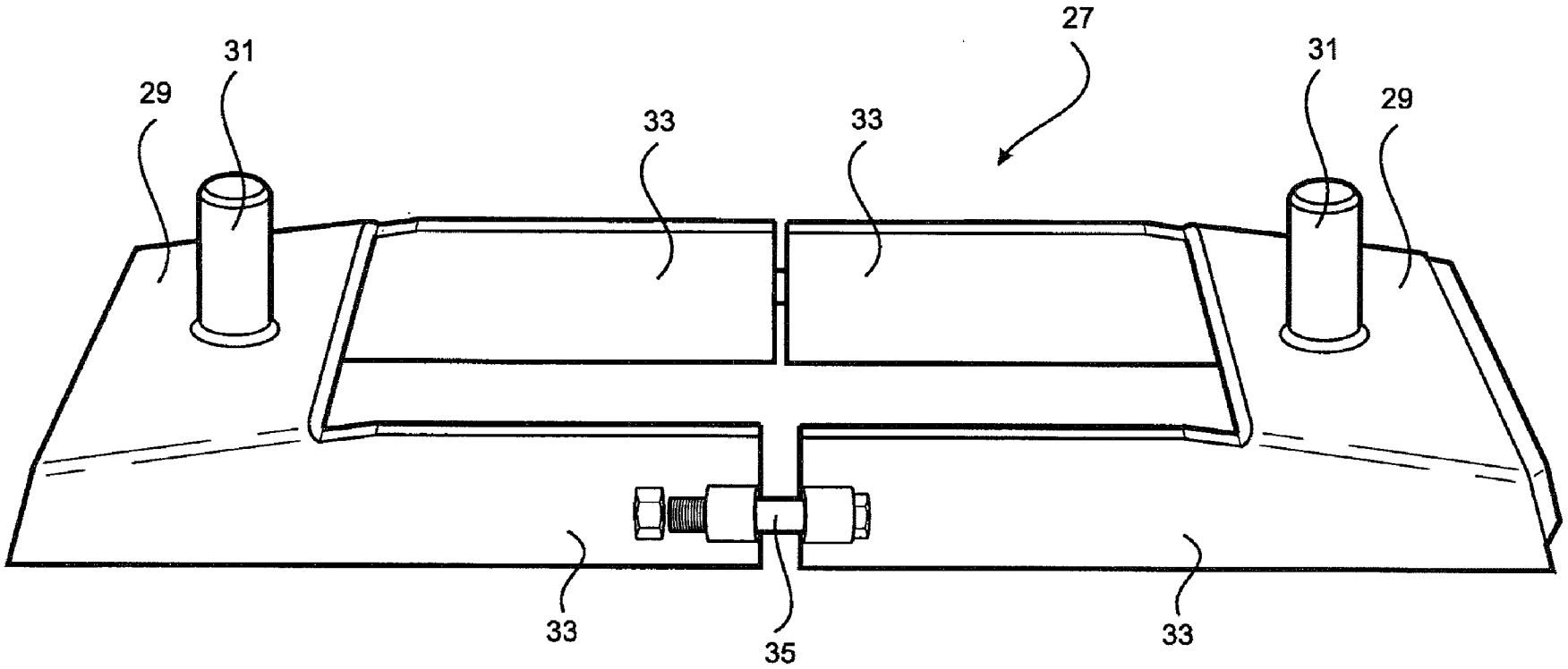
FIG. 3 is an isometric view of the support element according to the first embodiment.
Figure 4:
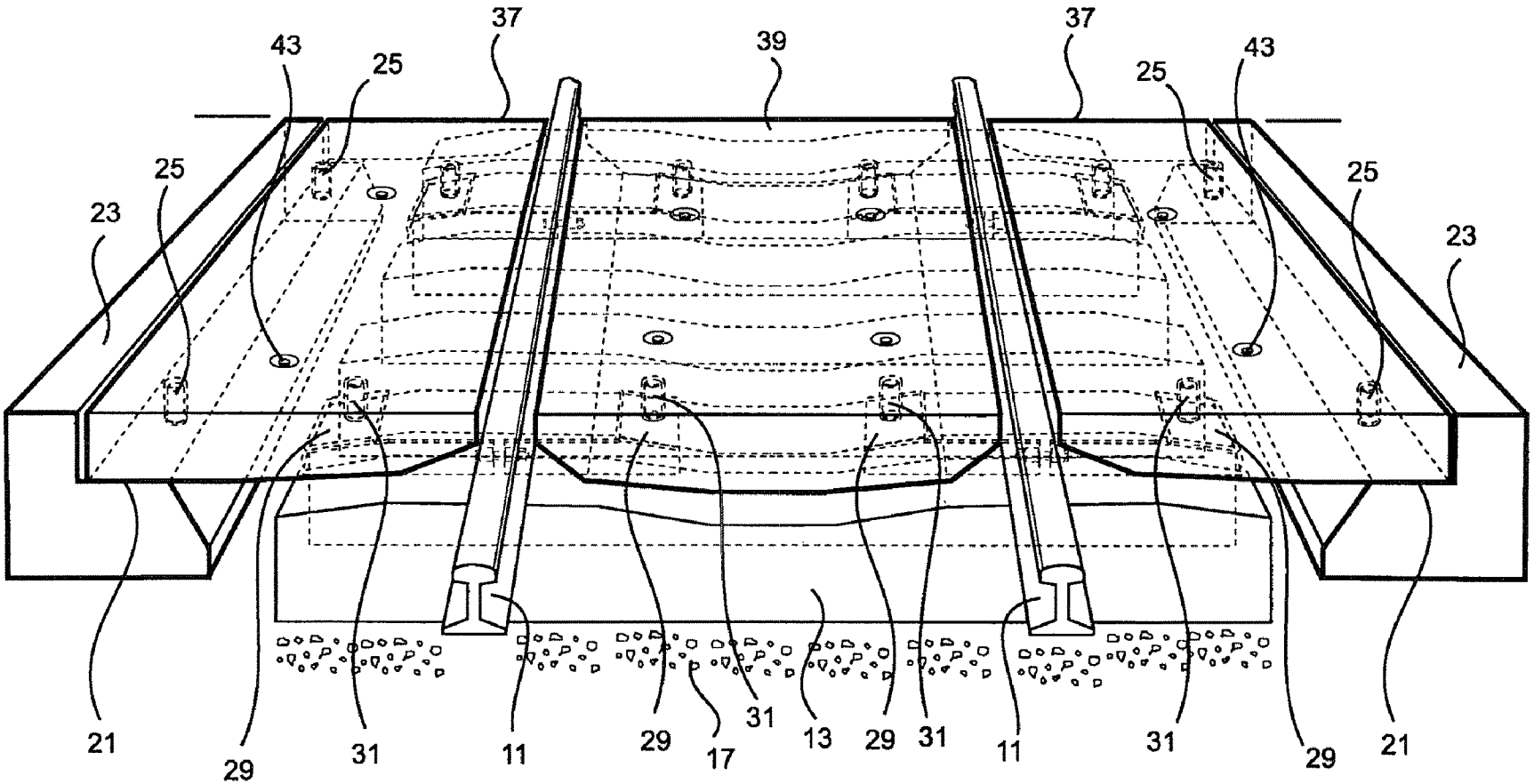
FIG. 4 is an isometric view of a rail track crossing according to the first embodiment.

The first embodiment as shown at FIGS. 1 to 4 is directed to a rail track crossing to provide access for road vehicles over a rail track.

The rail track as shown in the accompanying drawings comprises a pair of rails 11 which are supported in a spaced parallel relationship, with respect to each other, from a sleeper 13, whereby the sleeper is one of a set of sleepers located in a spaced relationship along the length of the rail track and where the rails are fixed to the sleepers by use of the suitable retention clips or the like 15. The sleepers are supported from the ground by a suitable ballast bed 17.

The rail track crossing according to the first embodiment comprises a pair of elongate lateral supports 19 which are located to each side of the rail track in spaced relation to the sleepers 13. The lateral supports are formed with an inner shoulder 21, which is lower than the upper surface 23 of the lateral support 19. Each shoulder 21 is provided with a set of engagement portions comprising upstanding first bosses 25 located at spaced intervals along the length of the lateral support 19. In addition the rail track crossing comprises two pairs of support elements 27 where the pairs of support elements are supported from spaced sleepers. The support elements of each pair are associated with each rail supported from the respective sleeper. Each support element extends to each side of the respective rail 11 and comprises a pair support portions 29 which are to be located to both sides of the respective rail and which is supported upon the upper surface of the sleeper 17. Each support portion 29 is provided with an engagement portion in the form of an upstanding second boss 31. In addition each support portion is formed with a pair of parallel extensions 33 which are to lie to each side of the sleeper and the parallel extensions of each support portion are to be inter-connected underneath the respective rail at their adjacent ends by suitable fixing means 35.

In addition the rail track crossing comprises a pair of lateral panels 37 and a central panel 39. Each of the panels 37 and 39 are formed of a reinforced concrete and the upper surface of each of the panels is covered with a suitable anti-skid preparation. Each of the lateral panels 37 are dimensioned to be receivable between a rail 37 and the adjacent lateral support 19, whereby they are supported from the shoulder 21 of the lateral support 19 and from the support portion 29 of each of the support elements 27. The central panel 39 is intended to be received between the rails 11 and is to be supported upon the support portions 29 of the support elements 27. Each of the panels 37 and 39 are formed with a recess in their undersurface where each recess is of complementary configuration to the first and second bosses 25 and 31 provided on the lateral support 19, and the support elements 27.

In addition the upper surface of each of the panels 37, 39 are provided with a set of recesses which accommodate a lifting point 43.

In addition resilient non-conductive support pads (not shown) are provided between the support portion 29 and each of the sleepers.

In use, each set of panels 37 39 are associated with a pair of support elements 27 which are associated with each rail 11 such that each end of the respective panel is supported from a support element. In the case of the sleepers which are not associated with a support element a resilient non-conductive pad or packer (not shown) is provided between the opposed faces of the sleeper and the panel. In addition, if desired a resilient pad (not shown) can be provided between the upbutting face of the lateral panels 37 and the shoulder 21 of the lateral supports 19.

The lower edge of each of the panels which is in abutting relationship with the respective rail is formed with a bevel like configuration 43 or the like which ensures that the panels lie clear of the retention clips 15 which support the rail from the sleeper.

In addition, each end of central panel 39 which are located between the rails 11 is provided with an inclined deflector plate (not shown) which extends outwardly and downwardly from the upper edge of the central panel 39.

Figure 5:
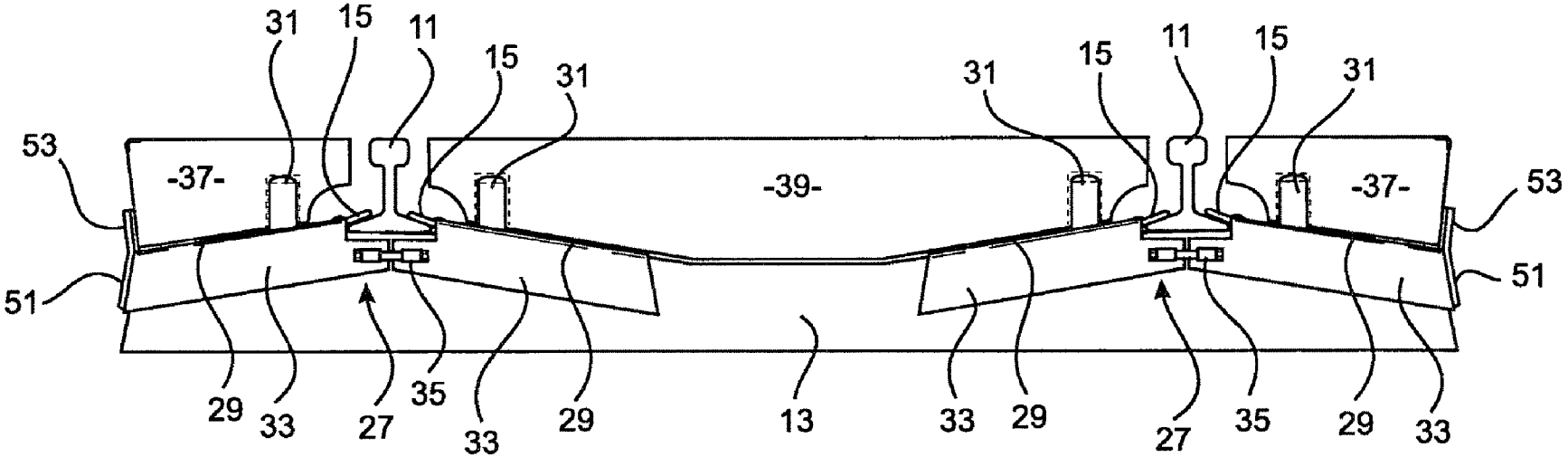
FIG. 5 is a sectional elevation of a rail track crossing according to the second embodiment.
Figure 6:
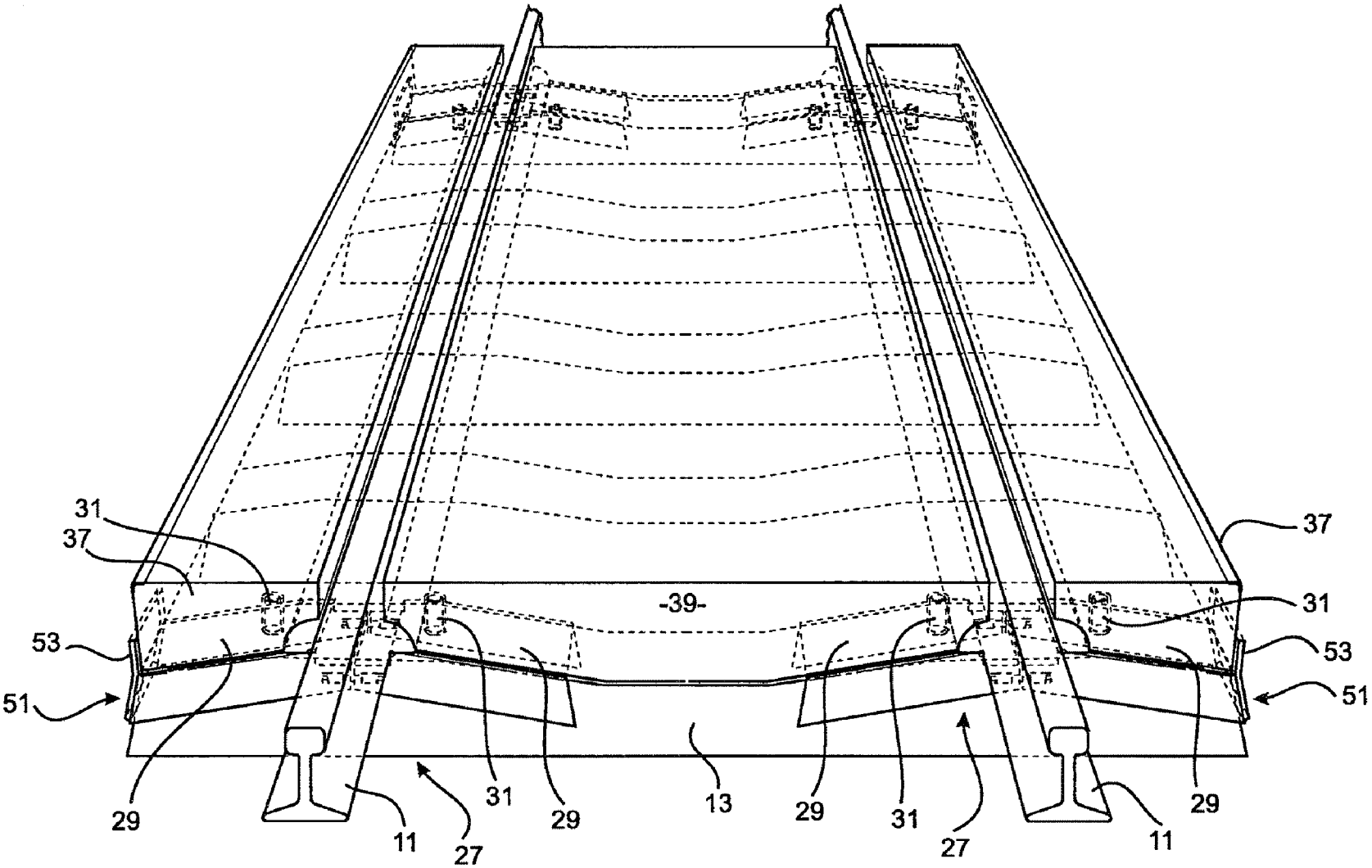
FIG. 6 is an isometric view of a rail track crossing according to the second embodiment.

The second embodiment as shown at FIGS. 5 and 6 is of a similar form to the first embodiment and the same reference numerals are used in the description of the second embodiment as are used in regard to corresponding components in the description of the first embodiment.

The rail track crossing according to the second embodiment does not comprise a pair of lateral supports which were a feature of the first embodiment. The rail track crossing of the second embodiment comprises two pairs of support elements 27 which are each to be supported upon a sleeper 17 where a pair of support elements are supported from one sleeper with a support element associated with each rail supported from the sleeper and the pairs of supports are supported from spaced sleepers. Each support element is of the same form as the support elements of the first embodiment and extends to each side of the respective rail 11 and comprises a pair support portions 29 which are to be located to both sides of the respective rail and which is supported upon the upper surface of the sleeper 17. Each support portion is provided with an engagement portion in the form of an upstanding second boss 31. In addition each support portion is formed with a pair of parallel extensions 33 which are to lie to each side of the sleeper and the parallel extensions of each support portion are to be inter-connected underneath the respective rail at their adjacent ends by suitable fixing means 35. The outer end of each support element which lies adjacent the end of the sleeper when in position on the sleeper is provided with an end plate 51 which overlies the end of the sleeper. The end plate is formed with an upward extension which provides an upwardly extending abutment 53 at the end of the support element.

In addition the rail track crossing comprises a pair of lateral panels 37 and a central panel 39. Each of the panels 37 and 39 are formed of a reinforced concrete and the upper surface of each of the panels is covered with a suitable anti-skid preparation. Each of the lateral panels 37 are dimensioned to be receivable over the end portion of the sleeper adjacent the outer side of the rail track whereby they are supported from the support portion 29 of the outer portion of the support elements 27. The central panel 39 is intended to be received on the adjacent ends of adjacent support elements between the rails 11 and to be supported upon the support portions 29 of the support elements 27. Each of the panels 37 and 39 are formed with a recess in their under-surface where each recess is of complementary configuration to the first and second bosses 25 and 31 provided on the lateral support 19, and the support elements 27.

In addition the upper surface of each of the panels 37, 39 are provided with a set of recesses which accommodate a lifting point 43.

In addition resilient non-conductive support pads (not shown) are provided between the support portion 29 and each of the sleepers.

In use, each set of panels 37 39 are associated with a pair of support elements 27 which are associated with each rail 11 such that each end of the respective panel is supported from a support element. In the case of the sleepers which are not associated with a support element a resilient non-conductive pad or packer (not shown) is provided between the upper of spaces of the sleeper and the panel. In addition, if desired a resilient pad (not shown) can be provided between the abutting face of the lateral panels 37 and the abutment 53.

The lower edge of each of the panels which is in abutting relationship with the respective rail is formed with a bevel like configuration 43 or the like which ensures that the panels lie clear of the retention clips 15 which support the rail from the sleeper.

In addition, each end of the central panel 39 which are located between the rails 11 is provided with an inclined deflector plate (not shown) which extends outwardly and downwardly from the upper edge of the central panel 39.

When it becomes necessary to service the rail track associated with the rail track crossing according to either the first or the second embodiment, the lateral panels 37 and the central panel 39 can be lifted out of engagement with the lateral supports 19 and the sleepers. This enables full access to the rails without disturbance of the rail track. In addition if it becomes necessary to engage the sleepers for the purposes of tamping or the like, this can be effected without having to remove the support elements 27 from the sleeper. Furthermore the presence of the interconnection 35 between the extensions 33 of each support element beneath the rail line 11 ensures that the interconnection will not be engaged by the tamping equipment. Upon completion of the servicing of the rail track the lateral panels 37 and central panel 39 can be reinstalled into the rail track crossing. As a result, the rail track crossing according to the first embodiment provides a means whereby a rail track can be readily and quickly serviced without long term disruption to the road and rail traffic over the crossing. In addition it is a characteristic of the rail track crossing that there is no contact between the respective rail and any component of the rail track crossing which ensures that the rail track is electrically insulated from the elements of the rail track crossing.

In addition where a crossing is formed with a plurality of sets of panels which are positioned in an end to end relationship along apportion of rail track the sets can be interconnected by tie rods or the like.

It is further characteristic of the first and second embodiments that the components of the rail track crossing are supportingly interconnected across the crossing by the support elements.

It is characteristic of the first embodiment that the lateral supports serve in keeping the road making material to each side of the rail track isolated from the ballast of the rail track.

Figure 7:
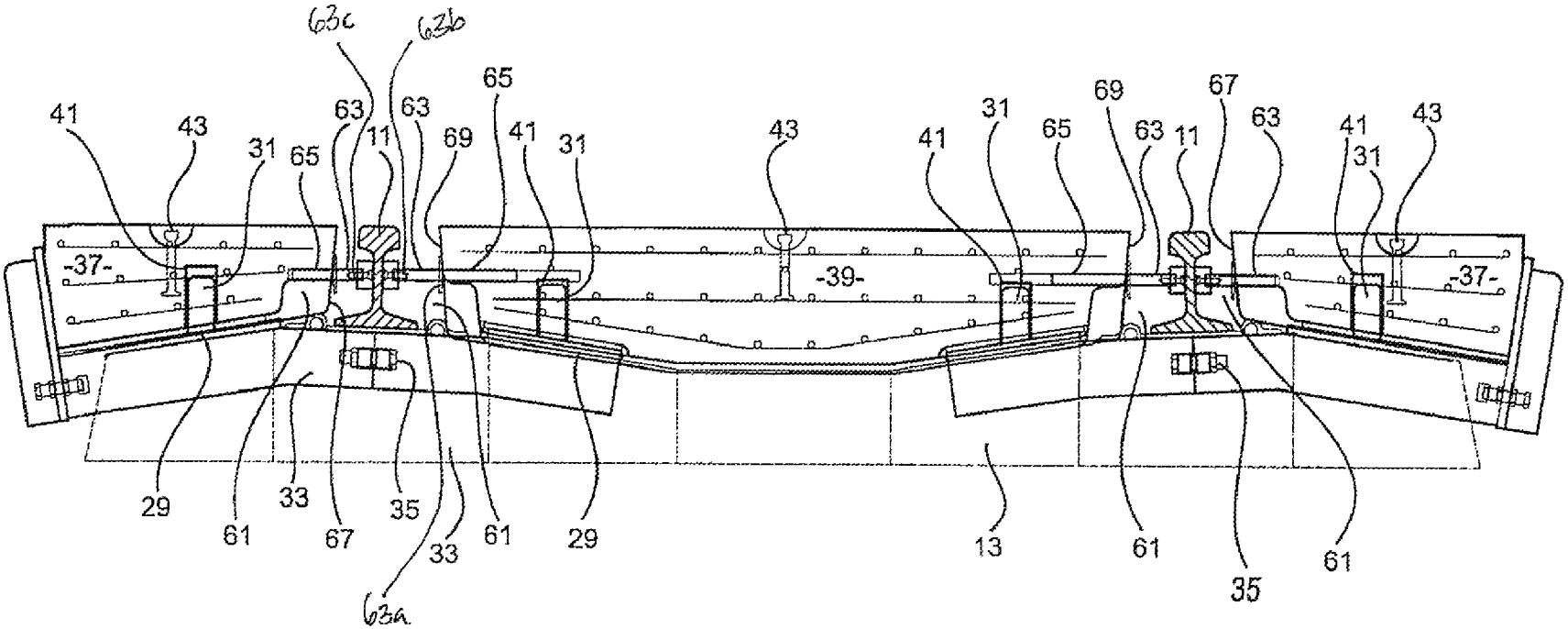
FIG. 7 is an isometric view of a section of a rail track crossing according to a third embodiment.

FIG. 7 shows a rail track crossing in accordance with a third embodiment of the invention. The rail track crossing 0 is substantially similar to the rail track crossing of the second embodiment, and like numbers are used to identify like parts.

Each of the lateral panels 37 is provided with rail engaging means 61, adapted to secure the lateral panel 37 against the rail 11. Each rail engaging means 61 comprises an extensible member 63 provided within a passageway 65 in the rail-facing side wall 67 of the lateral panel 37.

Each rail engaging means 61 is provided with a first locking means 63*a*, adapted to lock the extensible member in position against the rail, such locking means being known in the art and comprising, for instance, a washer which is held in place by an R-clip extending through an aperture in the extensible member 63. A second locking means 63*b* comprises one or more threaded apertures through the extensible member in which a pin 63*c* in the form of a bolt or the like element is receivable.

The central panel 39 is similarly provided with rail engaging means 61 on both rail-facing side walls 69.

In use, after the lateral panels 37 and central panel 39 are installed as described in the context of the first and second embodiments, the extensible members are extended to abut the rail 11 beneath the head 116 of the rail. The extensible members secure the panels 37 and 39 against vertical movement relative to the rails to ensure that the panels remain in position. The portions of the extensible members 63 abutting the rail 11 are formed from a non-conducting material, thereby not interfering with the signal carrying properties of the rail 11.

According to an alternative embodiment of the invention, each of the panels 37 and 39 are formed of a moulded polymeric material and the upper surface is formed to provide an anti-skid surface.

According to a further embodiment of the invention each of the panels 37 and 39 are formed of an elastomeric material such as granulated rubber and each have an upper surface which has anti-skid properties.

The present invention is not to be limited in scope by any of the specific embodiments described herein. These embodiments are intended for the purpose of exemplification only. Functionally equivalent products and methods are clearly within the scope of the invention as described herein.

The claims defining the invention are as follows:

1. A rail track crossing for a rail track having at least two rails, the rail track crossing comprising a pair of rigid support elements, each rigid support element associated with a rail of the rail track and configured to be supported from a sleeper, wherein each rigid support element extends to each side of the respective rail, each rigid support element having an engagement portion disposed at each side of the respective rail, a set of panels including a pair of rigid lateral panels and a rigid central panel wherein the rigid central panel is to be received between the rails and supported upon the rigid support elements and to be engaged by the engagement portions, the rigid lateral panels being disposed to the sides of the rail track to be engaged with the engagement portion located at the respective side, wherein when the rigid lateral panels and the rigid central panel are in position their upper surfaces jointly provide a substantially continuous surface across the rail track.

2. A rail track crossing as claimed at claim 1 wherein the plurality of support elements are located along the portion of the rail track accommodating the rail track crossing.

3. A rail track crossing as claimed at claim 1 wherein the outer portion of the support element proximate the respective outer side of the rail track has an upwardly extending abutment which is intended in use to engage the outer side face of the respective lateral panel.

4. A rail track crossing as claimed at claim 1 wherein the rail track crossing further comprises a pair of lateral supports which in use are to be located such that one is to be located to each side of the rail track in spaced relation from the sleepers and wherein the lateral panel is dimensioned such that its outer lateral portion extends beyond the sleepers and is to be supported from the respective lateral support.

5. A rail track crossing for a rail track including at least two rails, the rail track crossing comprising a pair of rigid lateral supports which in use are to be located such that one is to be disposed to each side of the rail track in spaced relation from the sleepers, a pair of rigid support elements associated with each rail and configured to be supported from the sleeper to each side of the respective rail, each rigid support element having a pair of engagement portions which are to be located at each side of the respective rail, a set of panels having top surfaces and including a pair of rigid lateral panels and a rigid central panel wherein the rigid central panel is to be received between the rails and supported upon the rigid support elements to engage the engagement portions, the rigid lateral panels being arranged to be located to one or the other side of the rail track between the lateral support and most proximate rail and to be engaged with the most proximate engagement portion, wherein when the rigid lateral panels and the rigid central panel are in position their upper surfaces jointly provide a substantially continuous surface across the rail track.

6. A rail track crossing as claimed at claimed 5 wherein each lateral support is provided with an engagement portion which is intended to be engaged with the respective lateral panel.

7. A rail track crossing as claimed at claimed 5 wherein a plurality of support elements are provided to be supported on sleepers located in spaced relation along the portion of the length of the rail track associated with the rail track crossing.

8. A rail track crossing as claimed claim 5 wherein a plurality of sets of panels are provided in an end to end relationship along the portion of the length of the rail track associated with the rail track crossing.

9. A rail track crossing as claimed claim 5 wherein, the engagement portions comprise an upstanding boss which is to be received within a recess of complementary configuration in the under face of the panels.

10. A rail track crossing as claimed at claim 5 wherein each support element comprises a support portion which is located in spaced relation to the respective side of the rail and an extension portion which extends from the support portion to terminate below the rail, wherein the extension portions of each support portion are capable of being interconnected at a position below the respective rail.

11. A rail track crossing as claimed at claim 5 wherein the panels are formed of reinforced concrete or like cementitious material.

12. A rail track crossing as claimed at claim 5 wherein the panels are formed of a polymeric or elastomeric composition.

13. A rail track crossing as claimed at claim 5 wherein the upper surface of the panels are provided with an anti-skid surface.

14. A rail track crossing as claimed at claim 5 wherein each of the panels are provided with lifting points whereby the panel can be engaged at the lifting points and lifted into and out of the position on the rail track.

15. A rail track crossing as claimed at claim 5 wherein, each lateral panel is provided with a rail engaging means, adapted to prevent upward movement of the edge of lateral panel adjacent the rail from the upper surface of the rail.

16. A rail track crossing as claimed at claim 5 wherein, the central panel is provided with a rail engaging means, adapted to prevent upward movement of the edge of central panel adjacent the rail from the upper surface of the rail.

17. A rail track crossing as claimed at claim 15 wherein the rail engaging means is provided in the form of an extensible member provided within an aperture in a rail-facing side wall of the lateral or central panel.

18. A rail track crossing as claimed at claim 17 wherein in use, the extensible member is extended from the aperture in the rail-facing side wall of the lateral or central panel to secure the lateral or central panel against the rail.

19. A rail track crossing as claimed at claim 18 wherein the extensible member is adapted to engage the rail beneath the head of the rail, thereby at least inhibiting vertical movement of the lateral or central panel.

20. A rail track crossing as claimed at claim 17 wherein the portion of the extensible member that in use is to abut the rail is formed from an electrically non-conducting material.

21. A rail track crossing as claimed at claim 17 wherein the rail engaging means is provided with a locking means, adapted to lock the extensible member in position against the rail.

22. A rail track crossing as claimed at claim 21 wherein the locking means comprises one of more apertures through the extensible member, and a pin, receivable through one of said apertures to maintain the extensible member in engagement with the rail.

23. A rail track crossing as claimed at claim 22 wherein, the pin comprises a bolt which is threadably receivable in the apertures.

24. A rail track crossing as claimed at claim 5 wherein, the underside of the lateral and/or central panels is formed with apportion which is shaped to be received between least one pair of adjacent sleepers to prevent axial movement of the panels relative to the rail track.

* * * * *